United States Patent [19]

Haessig et al.

[11] Patent Number: 4,942,921

[45] Date of Patent: Jul. 24, 1990

[54] FORCED AIR VENTILATION SYSTEM

[75] Inventors: David L. Haessig, Poway; Jamshid Hamidi; Roger V. Hort, both of San Diego, all of Calif.

[73] Assignee: Staefa Control Systems, Inc.

[21] Appl. No.: 150,247

[22] Filed: Jan. 29, 1988

[51] Int. Cl.[5] ..... G05D 23/00

[52] U.S. Cl. ..... 165/16; 236/13; 236/49.3

[58] Field of Search ..... 236/49 D, 13; 98/38.9, 98/34.6, 31.6; 165/16, 26; 455/606

[56] References Cited

U.S. PATENT DOCUMENTS

| | | | |
|---|---|---|---|
| 4,328,926 | 5/1982 | Hall, Jr. | 236/13 |
| 4,394,957 | 7/1983 | Newton, III | 236/46 F |
| 4,420,840 | 12/1983 | Livermore | 455/606 |
| 4,428,017 | 1/1984 | Vaerewyca et al. | 455/606 X |
| 4,560,103 | 12/1985 | Schulz et al. | 236/13 |
| 4,607,789 | 8/1986 | Bowman | 236/49.3 |
| 4,754,919 | 7/1988 | Otsuka et al. | 236/49.3 |

*Primary Examiner*—William E. Wayner

[57] ABSTRACT

The variable air volume ventilating system includes a control device for driving a fan at continuously variable speeds for delivering air to the space for conditioning purposes. A controller monitors various conditioners of the space, to, in turn, cause the control device to drive the fan at different continuously varying speeds. A light conduit, such as a fiber optic link, interconnects the control device and the controller for supplying a control signal to the control device.

19 Claims, 10 Drawing Sheets

Q2
98
103
Q3
2N4870
470
R3
470
R1
Q1
90
C1
R4
100nF
5%
71
10K
2W
R2
CR1
12V
73
BR1
94
AC
AC
101
92
47nF
C2
100nF
L1
0.1mH
R2
560
C3
74
M
75
AC
120 VAC

PARALLEL-FAN OPERATIONS
PRIMARY AIR DAMPER
HEATING ELEMENT
G
E
B
C
A
D
F
WARM
SET POINT
COLD
OFF
CLOSED
MIN. CFM
MAX. CFM
OPEN

FORCED AIR VENTILATION SYSTEM

DESCRIPTION

1. Technical Field

The present invention relates in general to a forced air ventilation system, and it more particularly relates to such a ventilation system, which is of a variable air volume ventilation system, which is improved as to its discharge air flow and its efficiency of operation.

2. Background Art

In modern variable air volume ventilating systems, a variable air volume terminal box or unit is used as a component of the ventilation system associated in close proximity with each individual space to be provided with conditioned air. The unit provides conditioned air to the space by opening and closing an air valve to increase or decrease the volume of cold air flowing into the space. When the cooling demand is low, the cooling volume and air movement in the space is low. Low air movement in spaces where the occupants are sedentary, creates uncomfortable surrounding for the occupants.

In one type of prior known variable air system is a parallel fan unit. The parallel fan variable air volume unit is a type of terminal unit designed to increase air circulation in the conditioned space when the cooling volume is low.

The parallel fan is turned on to deliver return air from the space to mix with the air being discharged into the space for conditioning the air flowing therein. However, with such a parallel fan operation, the air volume fluctuates between a rate which is frequently too high or excessive, and one which is undesirably too low. In this regard, when the fan is activated, the flow rate of air entering the room is an extremely high flow rate, which can be annoying to the occupants in the space. When the fan is turned off, the flow rate into the room is very low. Such low flow rate can produce air stagnation. Such air stagnation can be unhealthy to the occupants of the space. Moreover, by turning the fan on and off repeatedly, constant changes in the noise level in the space immediately below the unit are also annoying and highly undesirable.

In an attempt to overcome the problem of the parallel fan unit, a series fan unit has been employed. In such a series fan unit, a single fan is used to deliver air into the space from both a primary air source and the return air from the space. In so doing, the fan is activated at all times, and therefore, the noise level remains constant and is not unusually annoying, as compared to the parallel fan operation which cycles on and off. However, the series fan unit has not been entirely satisfactory for many applications, because such an arrangement is very expensive to operate, since the large series fan requires large amounts of energy to drive it. The cost of the energy to drive the fan, is excessive, and thus unwanted. Also, with such a series unit, a primary system which supplies the air to all of the spaces simultaneously, is difficult to control with the series fan arrangement.

Therefore, it would be highly desirable to have a fan unit which provides adequate air movement, similar to the air movement provided by a conventional parallel system, but without the abrupt changes in air volume and sound levels caused by the fan being turned on and off repeatedly. Also, such a new and improved system should minimize, or greatly reduce, energy consumption, as compared to a series fan arrangement. The fan unit should be designed so that it can be installed by persons other than highly-trained personnel. Also, the controller for the fan unit and its associated sensors and control devices should be arranged such that a simplified low voltage installation is possible. Additionally, it would be highly desirable to have such a fan unit which would not require special balancing of the system, once it is installed.

DISCLOSURE OF INVENTION

Therefore, the principal object of the present invention is to provide a new and improved variable air volume ventilating system, which provides sufficient air movement in a space, without abrupt changes in the supplied air volume and in sound levels.

Another object of the present invention is to provide such a new and improved variable air volume ventilating system, which minimizes, or at least greatly reduces, energy consumption, and which can be conveniently installed by individuals other than highly trained personnel, without the need for complex air balancing of the system.

Briefly, the above and further objects of the present invention are realized by providing a variable air volume ventilating system, which provides desirable air movement similar to, or even better than, a parallel system, but without the abrupt changes in the supplied air volume and in the sound levels usually found with conventional parallel systems due to fan noises associated with the starting and stopping thereof.

The variable air volume ventilating system includes a control device for driving a fan at continuously variable speeds for delivering air to the space for conditioning purposes. A controller monitors various conditions of the space, to, in turn, cause the control device to drive the fan at different continuously varying speeds. A light conduit, such as a fiber optic connection, interconnects the control device and the controller for supplying a control signal to the control device.

By controlling the fan speed continuously, according to the inventive technique, no annoying abrupt changes in starting and stopping of the fan is heard. At the same time, the fan is driven in an energy efficient manner, as compared to a constantly fully energized series installed fan.

The balancing of the static pressure of the ventilating system is not a problem, since the continuously varying fan speed control provides the desired balance. Thus, the requirement of having personnel balance each terminal unit to distribute the load uniformly throughout the building, is no longer a problem. With the inventive system, each terminal may only need to be adjusted for minimum and maximum flow rates in a relatively simple operation.

By providing a light conduit connection between the control device and the controller, the two units are isolated electromagnetically, so that the higher voltage control device modulating the fan, does not cause electromagnetic interference with the sensitive electronic circuits of the controller. Also, the controller is entirely a low voltage unit, which is relatively easy to install by persons other than highly trained personnel.

BRIEF DESCRIPTION OF DRAWINGS

The above mentioned and other objects and features of this invention and the manner of attaining them will become apparent, and the invention itself will be best understood by reference to the following description of an embodiment of the invention in conjunction with the accompanying drawings, wherein.

BEST MODE FOR CARRYING OUT THE INVENTION

The following is an outline of the following description:

(A) PRIOR ART PARALLEL FAN SYSTEM
(B) PRIOR ART SERIES FAN SYSTEM
(C) SYSTEM DESCRIPTION
(D) CONTROL DEVICE
(E) CONTROLLER
(F) CONTROLLER FIRMWARE

The following two sections describe two prior art systems.

(A) PRIOR ART PARALLEL FAN SYSTEM

Figure 1:
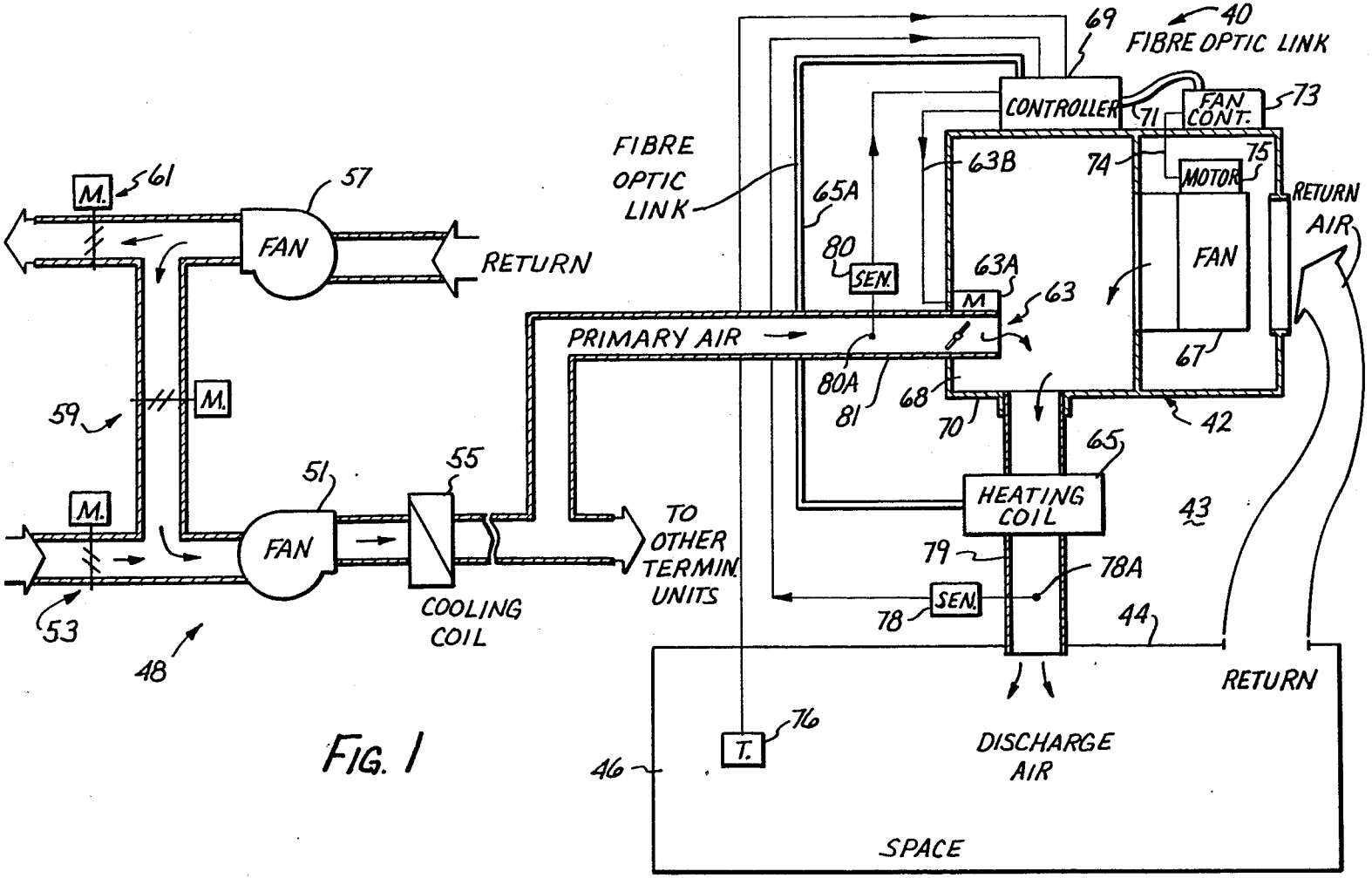
FIG. 1 is a schematic view of a variable air volume ventilating system, which is constructed in accordance with the present invention.
Figure 1A:
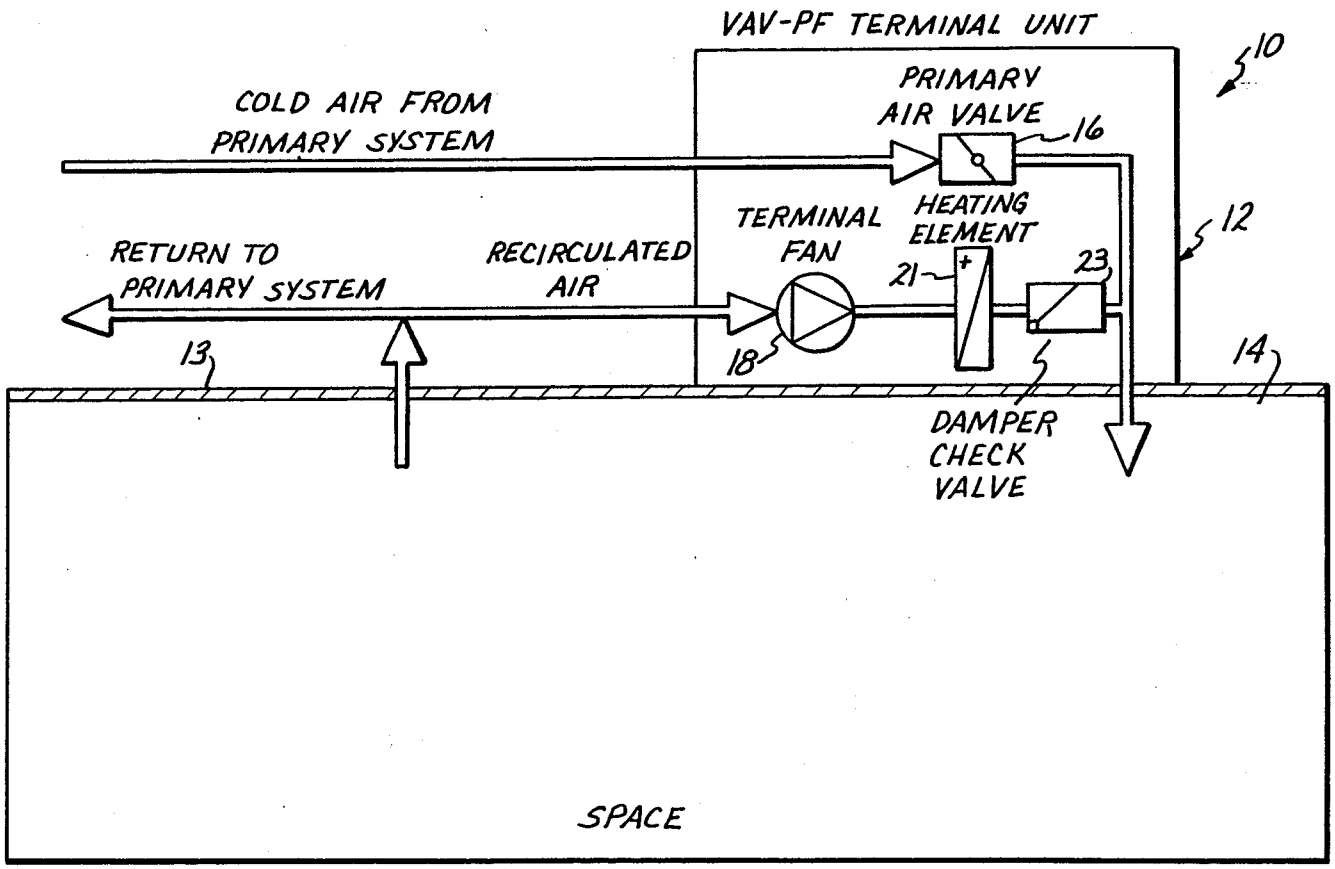
FIG. 1A PRIOR ART
FIG. 1A is a schematic diagram of a prior art parallel fan variable air volume system.

Referring now to FIG. 1A of the drawings, there is shown a parallel fan variable air volume system 10, which is a prior art system. The system 10 includes a variable air volume ventilating parallel terminal unit 12 which is mounted in a plenum area above a ceiling 13 for a space 14. A primary air valve 16 permits cold air from a primary air system (not shown) to be admitted to the space 14. In order to condition the air being delivered to the space 14, return air from the space 14 is recirculated, not only to the primary system, but also through a fan 18. A heating element 21 in the form of either an electrical heating coil or a hot water heating coil, heats the air from the discharge from the fan 18 and delivers the heated air through a back draft damper 23 in a parallel manner to mix with the cold air from the primary system prior to entering the space 14.

When the space temperature is above the setting of the variable air volume parallel fan controls, the primary air valve 16 is modulated toward the maximum position to provide additional cooling to the space. As the space temperature begins to drop, the primary air valve 16 is modulated toward the minimum position to reduce the amount of cooling to the space 14.

As the temperature continues to drop, the primary air volume continues to reduce the amount of air discharged into the space until the fan turn-on temperature is reached where the terminal fan 18 is activated. Some parallel fan systems have controls (not shown), which measure the primary air volume and turn the fan on by this measurement, instead of in response to a predetermined temperature. The fan supplies a fixed air volume into the space to make up the air circulation lost by the reduction in primary air. The fan volume may be adjusted at the time of installation, or by air balance by damper adjustment, or by selection of fan size.

If the space temperature continues to drop, the primary air valve 16 modulates to the minimum primary air volume position.

If the parallel fan system is fitted with a heating accessory, such as the element 21, a continued drop in temperature causes the air to be heated.

The parallel fan terminal unit 12 increases occupant comfort where the occupants are sedentary, by using the terminal fan to increase air circulation in the space when the primary air volume is low. However, such parallel terminal units causes occupant discomfort when starting the terminal fan causes abrupt changes in air volume discharged into the space and objectionable changes in the sound levels. These two unwanted and undesired conditions tend to disturb the occupant of the conditioned space, and are a major cause of occupant discomfort.

(B) PRIOR ART SERIES FAN SYSTEM

Figure 1B:
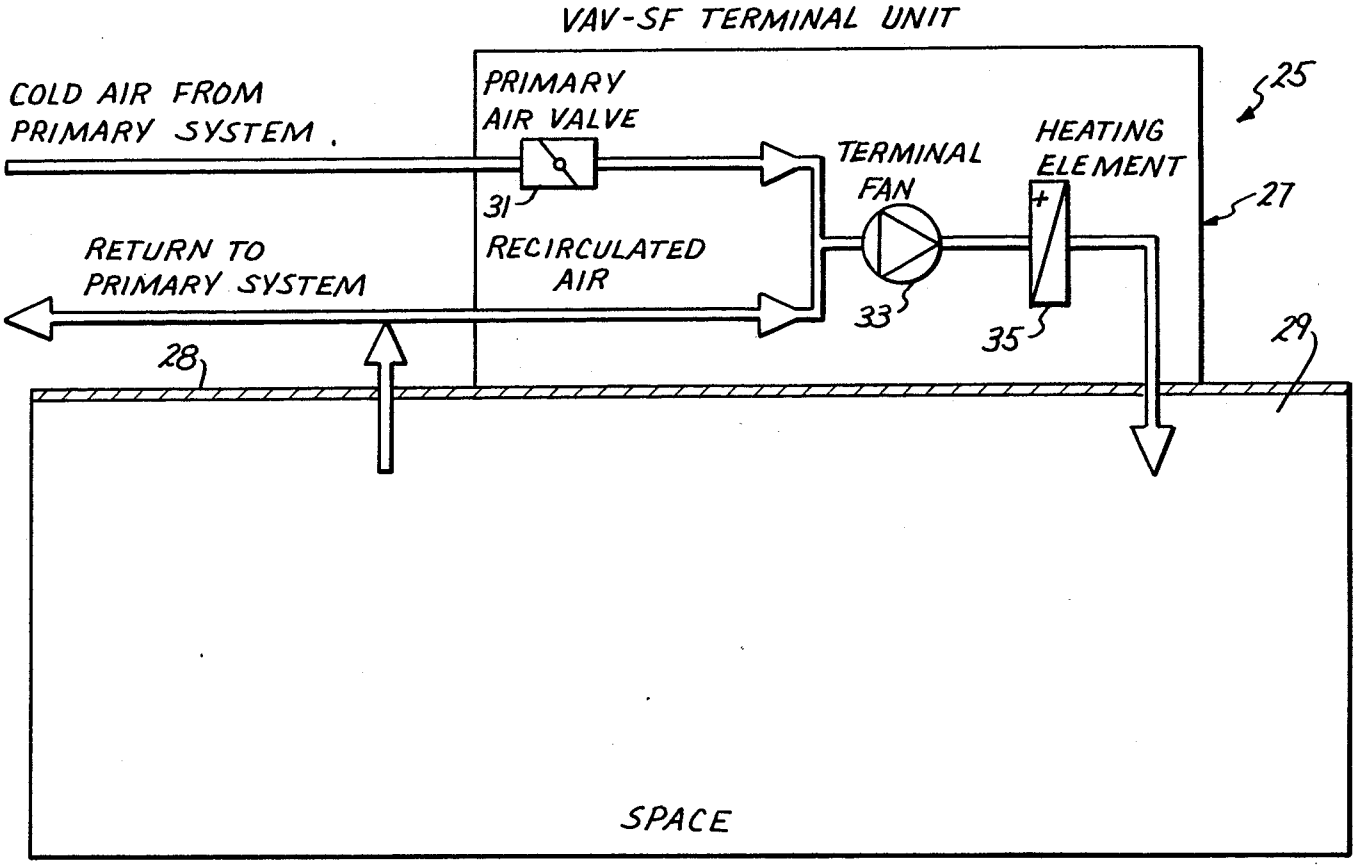
FIG. 1B PRIOR ART
FIG. 1B is a schematic diagram of a prior art series of variable air volume system.

Referring now to FIG. 1B, there is shown a series fan variable air ventilating system 25, which is a prior known system. The system 25 includes a variable air volume series fan terminal unit 27 which is mounted in a plenum above a ceiling 28 of a space 29. The system 25 includes a primary air valve 31 for permitting cold air from a primary air system (not shown) to flow through a terminal series fan 33 and a heating element 35 and into the space 29. The heating element 35 can either be an electrical heating element or a hot water coil element.

Air from the space is returned to the terminal fan 33 and through the heating element 35 to mix with the cold air from the primary space. The primary air system is balanced to provide zero differential pressure between the terminal fan inlet and the primary air pressure. This allows the fan to draw equally from the return air or primary air.

When the space temperature is above the setting of the system controls (not shown), the primary air valve 31 is modulated toward the maximum position. The fan 33 draws more cooling air from the primary supply and less return air from the space 29. The discharge air volume remains constant, but the discharge air temperature is close to the primary air (cooling) temperature, thereby increasing cooling to the space.

As the space temperature begins to decrease, the primary air valve 31 is modulated toward the minimum position reducing the amount of cooling air and increasing the amount of return air drawn by the fan. The air volume remains constant, but the discharge air temperature is close to the return air temperature, thereby reducing cooling to the space. The fan volume may be fixed at the time of installation or air balanced by damper adjustment, or selection of fan size.

If the temperature of the air in the space 29 continues to drop, the primary air valve 31 modulates to the minimum primary air volume position, thereby permitting the terminal fan 33 to draw a minimum amount of fresh air from the primary supply and most of the air from the return supply.

If the series fan unit is fitted with a heating accessory, such as the heating element 35, a continued decrease in temperature causes the air to be heated. Many prior art series fan terminal units heat the return air served to the heating element by the fan. Series fan terminals increase occupant comfort, where the occupants are sedentary, by supplying a constant volume of air to the space, while varying the discharge temperature to control the temperature. Such terminal units are expensive, difficult to set-up and require frequent air balance to maintain proper operation.

The terminal fan 33 must be sized to supply all load conditions. Therefore, more air volume is being supplied to the space than is required for comfort during all but peak cooling periods. These periods represent less than 10% of a typical building's operating time. The terminal fan 33 must be sized to accommodate these peak loads. Therefore, the cost of the terminal is increased over a parallel fan or the like. In addition, continuous operation of the fan at a volume required only about 10% of the time, creates a continuous waste of energy. Thus, the cost of operation is excessive and thus unwanted.

Maintaining air balance can be difficult. The primary air static must be set and held to close tolerance to maintain rangeability of the primary air valve 31. Air balancing requires accurate setting of the fan volume. The fan volume may be fixed during air balance by damper adjustment. Such adjustments require access to the terminal unit, which is usually mounted in the ceiling, in or near the conditioned space.

(C) SYSTEM DESCRIPTION

Referring now to FIG. 1, there is shown a ventilating system 40, which is constructed in accordance with the present invention. The system 40 includes a variable air volume terminal unit 42, which is mounted in a plenum space 43 above a ceiling 44 of a space 46. A primary system 48 supplies cold air through the terminal 42 to the space 46.

The primary air system 48 includes a fan 51 which draws air from a mixed air plenum or duct through a motor-driven dampers 53 and 59 discharges it through a cooling coil 55. The cooled air then flows into the parallel connected terminal units, such as a unit 42 for each space, such as a space 46. The other terminal units are not shown, but are similar to the unit 42. A return-exhaust fan 57 draws air returned from the spaces being conditioned, and discharges it through a motor driven damper 59 and into the inlet of the fan 51 for mixing with air entering therein. Also, a motor driven damper 61 discharges return air from the discharge of the fan 57 to the outside environment.

The terminal 42 includes a motor driven damper 63 for admitting the primary air under pressure into the interior of a mixing chamber 68 of the terminal 42, and from there, flows through a heating coil 65 and into the space 46. As is well known in the art, a heating coil is optional, and thus, may be omitted.

A terminal fan 67 draws return air from the space into the mixing chamber 68 of the terminal 42. The return air can either be from the interior of the plenum above the ceiling 44, or it can be guided by a duct (not shown). The discharge of the fan 67 is directed into the chamber 68 within the terminal 42 for mixing with the primary air admitted thereto from the primary air system 48. Thus, the cold primary air is mixed with the returned air from the space 46 and the mixed air is heated, if required, by the heating coil 65, prior to being discharged into the space 46.

A controller 69 is mounted on the outside of a housing 70 of the terminal unit 42, which in turn is disposed in relatively close proximity to the space 46. The controller 69 monitors continuously a set of variable conditions of the air in the space 46 and of the air entering the space. The controller 69 generates a continuously varying control signal indicative of the desired quantity of air under pressure being supplied to the mixing chamber 68 for the purpose of conditioning the air in the space 46. A fiber optic link or light conduit 71 is interconnected between the controller 69 and a fan control 73, for supplying the control signal thereto. Therefore the signal supplied via the link 71 and band control 73 is one of the pair of signals indicative of a desired quantity of return air coming from the space 46.

The fan control 73 is also mounted on the outside of the housing 70 of the terminal 42 adjacent to the fan 67 mounted on the inside of the housing 70. The fan control responds to the control signal received via the fiber optic link 71 to cause the motor device in the form of the fan 67 to vary continuously the flow rate of the quantity of air under pressure entering the mixing chamber 70 for conditioning the air being discharged into the space 46.

As hereinafter described in greater detail, in reference to FIG. 2, the controller 69 causes the control signal to vary in an proportional manner relative to the flow rate of the primary air under pressure entering the mixing chamber 68.

The fan control 73 responds to the control signal received via the fiber optic link 71 to provide a high-voltage continuously varying pulse width modulated signal via a lead 74 to a motor 75 driving the fan 67 continuously.

The controller 69 generates the control signal sent via the fiber optic link 71 to the fan control 73, in response to a set of variables. In this regard, an air flow sensor 78 having an element 78A in a duct 79 conveying the air into the space 46. The sensor 78 provides a signal to the controller 68, which signal is indicative of the air flow rate of the conditioned air being discharged into the space 46.

A thermostatic control element 76 is disposed within the space 46, and amongst other things, provides a signal to the controller 69, which signal is indicative of the temperature of the air within the space 46. The device 76 is also used for setting a desired temperature for the space 46. Additionally, by means of a suitable service tool (not shown), the device 76 can be connected electrically to, for sending information to the controller 69 to set minimum and maximum flow rates for the terminal unit 42.

An air flow sensor 80 includes an element 80A disposed within a duct 81, which guides the primary air into the mixing chamber 68. The sensor 80 provides a signal indicative of the flow rate of the primary air under pressure entering the mixing chamber 68. The temperature of the primary air may typically be 55°, and it mixes in the mixing chamber with returned air from the returned air space 46 at, for example, a higher temperature.

An electric damper motor 63A for the main air valve or damper 63 is controlled by a response to a signal received via the lead 63B from the controller 69. As hereinafter described in greater detail, the signal for driving the motor 63A depends on the other conditions being monitored by the controller 69. Thus the signals received via the lead 63B is the other one of the pair of signals indicative of the desired quantity of the currently available primary air under pressure. In additional the controller 69, the control element 76 and the sensors 78 and 80 in response to the signals generated by elements 78A and 80A provide a means for controllably measuring the quantity of primary air currently available for entering the space 46, the temperature of the air in the space 46 and the volume of air entering the space 46.

A fiber optic link or light conduit 65A conveys a continuously varying signal from the controller 69 to the heating element 65. Thus, the element 65 is driven by the signal to modulate the amount of heating of the air being discharged into the space 46.

The terminal unit 42 varies the volume of the terminal fan 67 to eliminate the discomfort associated with prior art parallel fan terminal and economically provide the benefits of the series fan terminal. When the space temperature is above the setting of the controls, the primary air valve 63 is modulated toward the maximum position to provide additional cooling to the space.

As the space temperature begins to decrease, the primary air valve or damper 63 is modulated toward the minimum position reducing the amount of cooling to the space 46.

As the temperature continues to drop the primary air volume reduces the amount of air circulated in the space to the fan turn-on temperature or (primary) volume, the terminal fan is controlled to a minimum fan volume. The fan turn on point is set to accommodate the minimum ventilation requirements of the space provided by the primary air.

As the temperature in the space continues to decrease, the primary air volume is reduced and the terminal fan volume is increased a proportionate amount. The process efficiently and comfortably provides a substantially constant air volume to the space 46 when the temperature of the air into the space is below the fan start point.

As the space temperature continues to drop, the primary air valve 63 modulates to the minimum primary air volume position in response to the signal received from the controller 69 via the lead 63A. At the same time, the fan speed modulates to a maximum fan volume. This volume is adjusted so the sum of the minimum primary volume and the maximum fan volume equal the sum of the primary air volume at the point of fan turn-on and the minimum fan volume. With the heating element 65, a continued drop in temperature causes the air to be heated.

The system 40 provides the air movement comfort of the conventional parallel fan terminal unit 12 (FIG. 1A), without the objectionable occupant discomfort caused by abrupt changes in air volume and sound levels when the fan starts and stops periodically. The inventive system 40 also can replace the series fan terminal 27 (FIG. 1B). This replacement reduces purchase, maintenance and operating energy costs, because the fan 67 may be smaller in capacity since it is not required to serve peak cooling loads. Additional energy savings are realized where energy efficient control of the parallel terminal fan volume is performed.

The fan control 73 is preferably a phase cut motor speed/resistive modulator element. A conventional connection of the control signal between a controller and a phase cut modulator heating element, such as a conventional heating element, is by a two wire connection (not shown). The two wire connection requiring two wire terminations at each end, is prone to wiring errors, and may transmit electro magnetic interference (EMI).

The fiber optic connections for both the fan control 73 and the heating element 65, require only one termination at each end, are not prone to wiring errors, and do not transmit EMI noise signals, which can cause malfunctions.

Conventional phase cut modulator elements applied to motor speed control, require the power setting to be high enough to start the motor turning from a dead stop. This limits the minimum speed to 50% or greater with many motor types.

The controller 69 overcomes start up hysteresis of the motor by providing a full on start pulse to the motor before backing down to the minimum speed. This feature allows the motor speed to be set lower than that required by the motor start power.

The ideal phase cut modulator element varies the power to a load as a linear function of the input or control signal. The power is regulated by switching the power on during a portion of each half cycle of an alternating current power source. Full power is supplied to the load when the power is switched on at the beginning of each half cycle and off at the end of each half cycle. Partial power is supplied to the load by holding power off for a period of time beginning at the start of each half cycle.

Figure 1C:
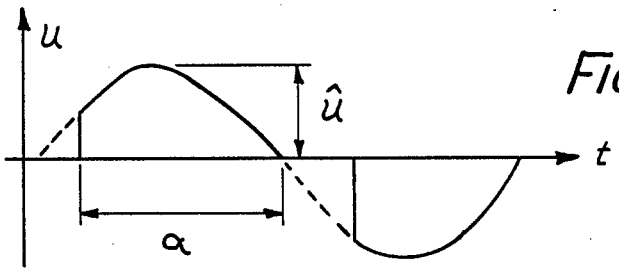
FIG. 1C is a schematic representation of the sinusoidal waveshape of the A.C. power.
Figure 1D:
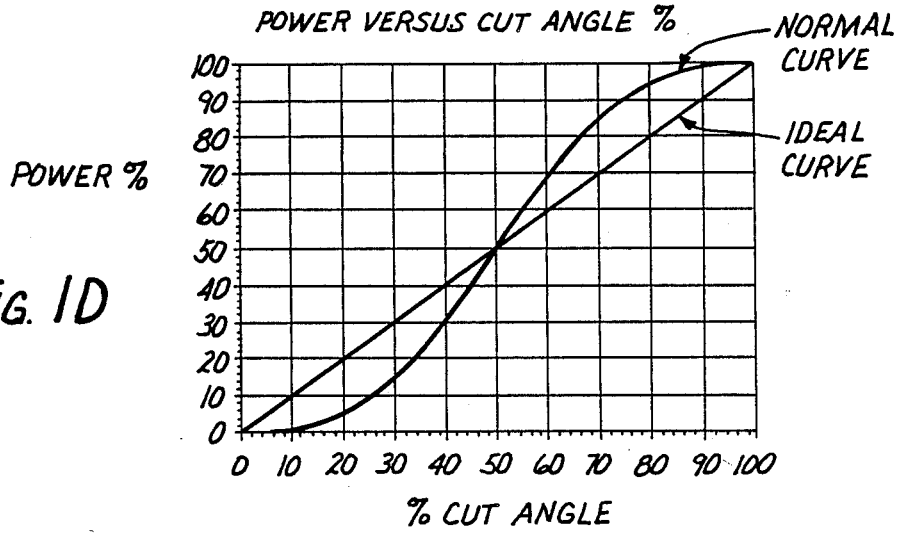
FIG. 1D is a schematic representation of the ideal curve of Power versus Cut Angle Percentage.
Figure 6A:
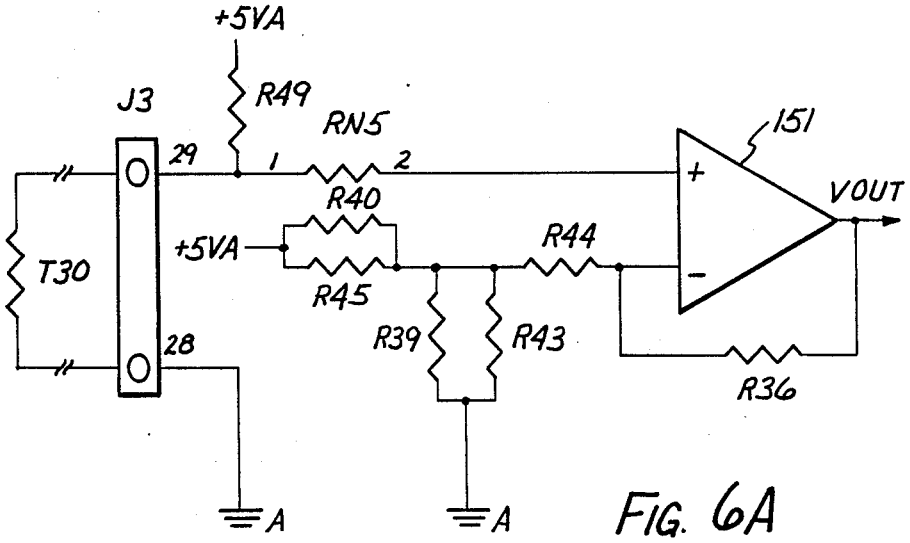
FIGS. 5, 6, 6A, and 7 are circuit details of the controller of FIG. 4.

Conventional phase cut modulator elements linearly vary the pulse width as a function of the control signal to develop the output power. This method of modulation creates linearity distortion, because the pulse amplitude, as well as the width varies. As shown in FIGS. 1C and 1D, this variation follows the sinusoidal waveshape of the A.C. power. The following table demonstrates this distortion:

| INPUT SIGNAL | NORMAL OUTPUT | IDEAL OUTPUT |
|---|---|---|
| 00% | 00.00% | 00% |
| 10% | 00.645% | 10% |
| 20% | 04.863% | 20% |
| 30% | 14.86% | 30% |
| 40% | 30.65% | 40% |
| 50% | 50.00% | 50% |
| 60% | 69.35% | 60% |
| 70% | 85.14% | 70% |
| 80% | 98.14% | 80% |
| 90% | 99.35% | 90% |
| 100% | 100.00% | 100% |

$$P = \frac{\hat{U}^2}{R\pi} \quad \frac{x}{2} - \frac{\sin 2x}{4}$$

R = resistive load
$\hat{U}$ = peak voltage

The controller 69 corrects this linearity problem by adjusting the pulse width to compensate for the changing pulse amplitude. The result is a modulator element which controls the output power closer to the power called for by the control signal.

This feature allows more accurate control of motor speed of the fan motor 75 and the resistive heating element 65. This feature, the starting pulse feature, and the minimum and maximum setpoint feature, enable phase out modulation of fan and other motor speed to be applied to a broader range of motor types and applications. These features enable the system 16 to perform satisfactorily to replace high cost variable frequency drives in many applications.

The controller 69 provides the ability to set a minimum and maximum fan volume setpoint using remote communications ability designed into the controller 69. Conventional adjustment of a VAV fan requires access to the fan speed control (not shown) which is usually mounted in the ceiling next to the fan.

The controller 69 allows the fan 67 to be adjusted remotely using an automation system or local service tool (not shown) connected at a convenient location, i.e. the room temperature sensor 76 or at the VAV primary system 48. This feature saves installation and maintenance time, because time consuming ceiling entry is not required for fan adjustment.

Conventional controls allow fresh air from the primary duct to be introduced into the space at all times. Fresh air is required when the space is occupied to provide comfort as defined by local building codes. When the space is not occupied, conventional controls continue to provide the space with fresh air by maintaining the minimum primary air volume.

The controller 69 can be locally controlled or remotely commanded to one of three occupancy sequences: occupied, standby, and unoccupied. When performing the occupied sequence, the controller 69 controls the space 46 to occupied setpoints and provides fresh air by maintaining a minimum primary air volume.

When performing the standby sequence, the controller 69 controls the space to occupied setpoints keeping the space ready for immediate occupancy. Since the space is not occupied, fresh air is not needed. The minimum primary air volume is set to zero.

When performing the unoccupied sequence, the controller 69 controls the space to temperatures set to protect the structure and contents during long (overnight) periods of unoccupancy. Since the space is not occupied, fresh air is not needed. The minimum primary air volume is set to zero.

Setting the minimum primary air volume to zero during periods of unoccupancy saves fan and thermal energy. When the space 46 is not occupied, the cold air supplied for minimum fresh air requires fan energy to supply and may over cool the space requiring heating of the air being discharged into the space.

The controller 69 allows the user to correct minor errors in input sensor readings caused by wire resistance or offsets in sensors. Auto calibrate applies, but is not limited to temperature and air volume readings.

Conventional VAV controllers require temperature calibration to be performed by mechanical adjustment of a potentiometer (not shown) or other mechanical device mounted on the VAV controller. The VAV controller is usually mounted in a ceiling on the VAV terminal, and thus such an adjustment is awkward to perform.

The controller 69 allows remote calibration of the controller; either from an automation system or with a service tool connected at the room sensor. This provides increased accuracy and a more efficient and easy to perform technique of sensor calibration.

Conventional VAV controllers require air balancer personnel to measure air volume for each required setting. These settings typically include: minimum primary air volume, maximum primary air volume, heating primary air volume, fan or primary air volume and fan volume.

The controller 69 allows the air balancer personnel to enter the measured value at one point with the air valve between half and full open. The person simply calibrates the controller 69 to the measured reading using the service tool or automation system (not shown). The required setpoints are then entered into the controller 69 using the service tool.

The air balancer personnel does not have to make a measurement for each setting since the processing power of the controller 69 and the service tool calculate the appropriate curve and engineering unit factors from the calibration point and air volume sensor type. The result is greatly reduced time to air balance the terminal units in a building, and greater air balance accuracy is achieved.

Conventional VAV controls position the primary air valve from minimum primary air volume to heating primary air volume whenever heat is called. If the source puts out a constant amount of heat, the heating primary air volume is selected to provide the air velocity required to drive the resulting temperature of heating air into the space being heated.

When the source puts out a variable amount of heat (proportional control), the heating primary volume is selected to provide the air velocity required to drive the resulting temperature of heating air into the space being heated when the heating source is at partial (80%) of capacity. When the heating source is below the design point, the discharge air temperature is lower; therefore, the higher air volume is not required. This higher air volume wastes fan energy, cooling energy and heating energy. Many times, space humidity is driven down to a level where space humidification is required. When the heating source is above the design point, the air velocity may be too low to provide satisfactory dispersion of the heating air into the space.

The controller 69 applies a unique process to control of proportional heat with a non-fan type VAV terminals. Before the controller enters heating, the primary air volume is at minimum position. A heating primary air volume setpoint is also set in the controller. This setting is the volume of primary air required to develop the velocity required to distribute the heated air when the heating source is at 100%.

As the temperature decreases, the controller 69 proportions the heat being applied. As the heating supply is turned on, the primary air volume is proportionately controlled between the minimum primary air volume and the heating primary air volume. For example, if the heating source is at 25%, the primary air volume is at M+25% (H-M) where H equals the heating primary air volume and M equals the minimum primary air volume.

This process prevents the occupants from being "shocked" with cold air when the heating source is providing less heating energy than the cooling energy supplied by heating primary air volume. Fan energy is not wasted by providing more velocity than is required to mix the heating air into the space. Thermal energy, both cooling and heating, are saved, and dehumidification of the air is reduced.

Figure 2:
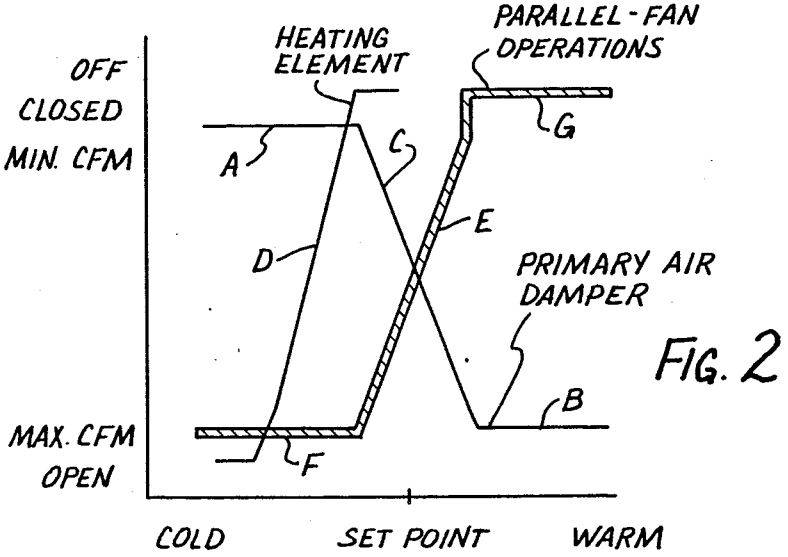
FIG. 2 is a graph showing the operation of the system of FIG. 1.

Referring now to FIG. 2, there is shown a graph of the operation of the system 40. The operation of the primary air damper 63 is shown characteristically as it is moved under the control of the controller 69 between a closed position at a minimum cubic feet per minute flow rate, to a maximum opened cubic feet per minute flow rate. It should be noted that as the temperature varies between cold and warm conditions in the space 46 of FIG. 1, the damper moves from a full closed position at A, to a full closed position at B. A linear transition occurs at C. Prior to the transition of C, the heating element is activated and transverses between a low position to a high position through a linear transition at D. At its high position, the fan 67 is turned on and transitions at E from a low or minimum position at F to a high or maximum position at G. Therefore, it should be noted that the primary air damper position is controlled linearly at C relative to the linear control of the fan at E, relative to an intermediate set point of the temperature in the space 46.

(D) CONTROL DEVICE

Figure 3:
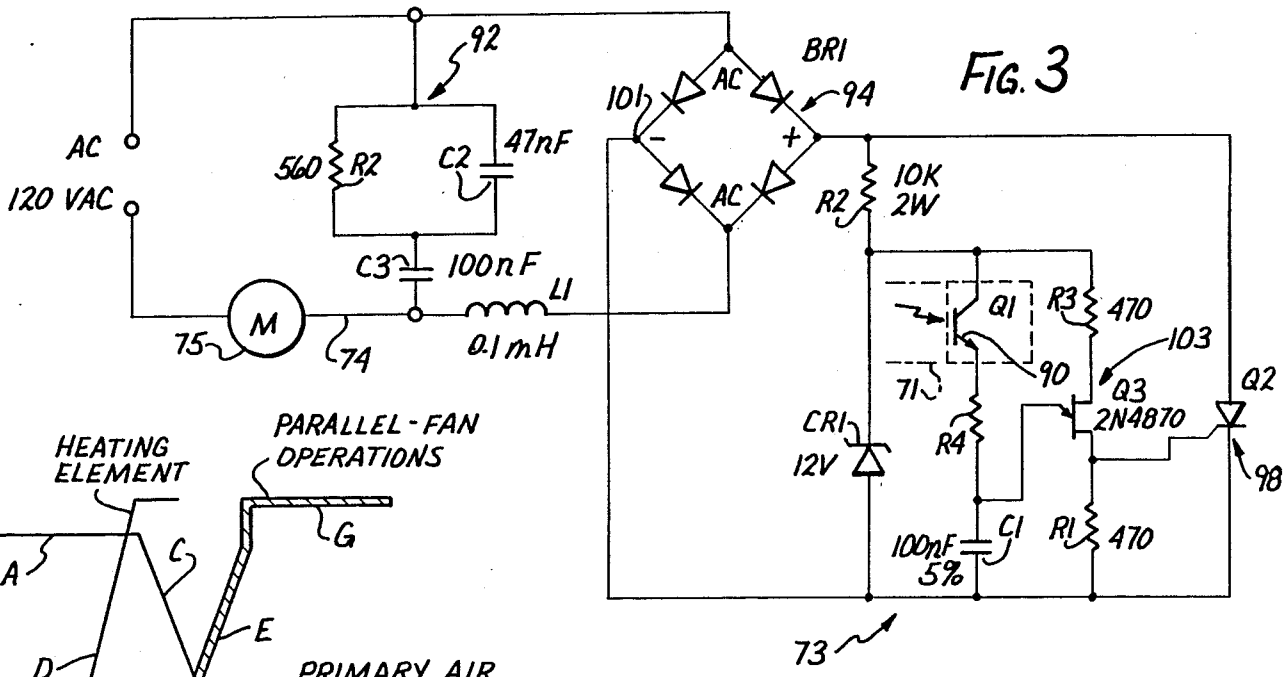
FIG. 3 is a schematic circuit diagram of the fan control of FIG. 1.

Referring now to FIG. 3, there is shown the fan control 73 for controlling the operation of the fan motor 75. The fan speed control 73 is a series control devices which is placed in series with the motor 75 to be controlled. The control signal is optically coupled to a photo transistor 90 via the fiber optic link 71 connected at its other end to an output of the controller 69.

A low pass filter 92 is provided to limit the EMI noise generated by the controlling of the fan motor. The filter elements C2, C3, R5 and L1 are used to eliminate or at least greatly reduce the noise interference.

A bridge rectifier 94 is used to convert the AC supply voltage at 96 to DC before it is supplied to a silicon controlled rectifier 98 and the control circuit. The SCR 98 is the switching device which turns on and off in response to the control signal, and therefore varies the amount of power being supplied to the motor 75.

The pulse width modulated signal sent by the controller 69 is received by the fiber optic receiver transistor 90. The frequency of this signal is 120 Hz and on each cycle, depending on the logical state of this signal the SCR 98 is turned on or off. This signal is synchronized to the line frequency.

In the off state, the fiber optic receiver transistor 90 is turned OFF. Since there is no current flow, a capacitor C1 connected through a resistor R4 to the emitter of the photo transistor 90, and connected at its other terminal to a negative terminal 101 of the bridge rectifier 94, is not charged. Thus, a unijunction transistor 103 having its base connected between the resistor R4 and the capacitor C1, is biased to be OFF. This also causes the SCR to be turned off, and therefore no current is supplied to the motor 75.

(E) CONTROLLER

Figure 4:
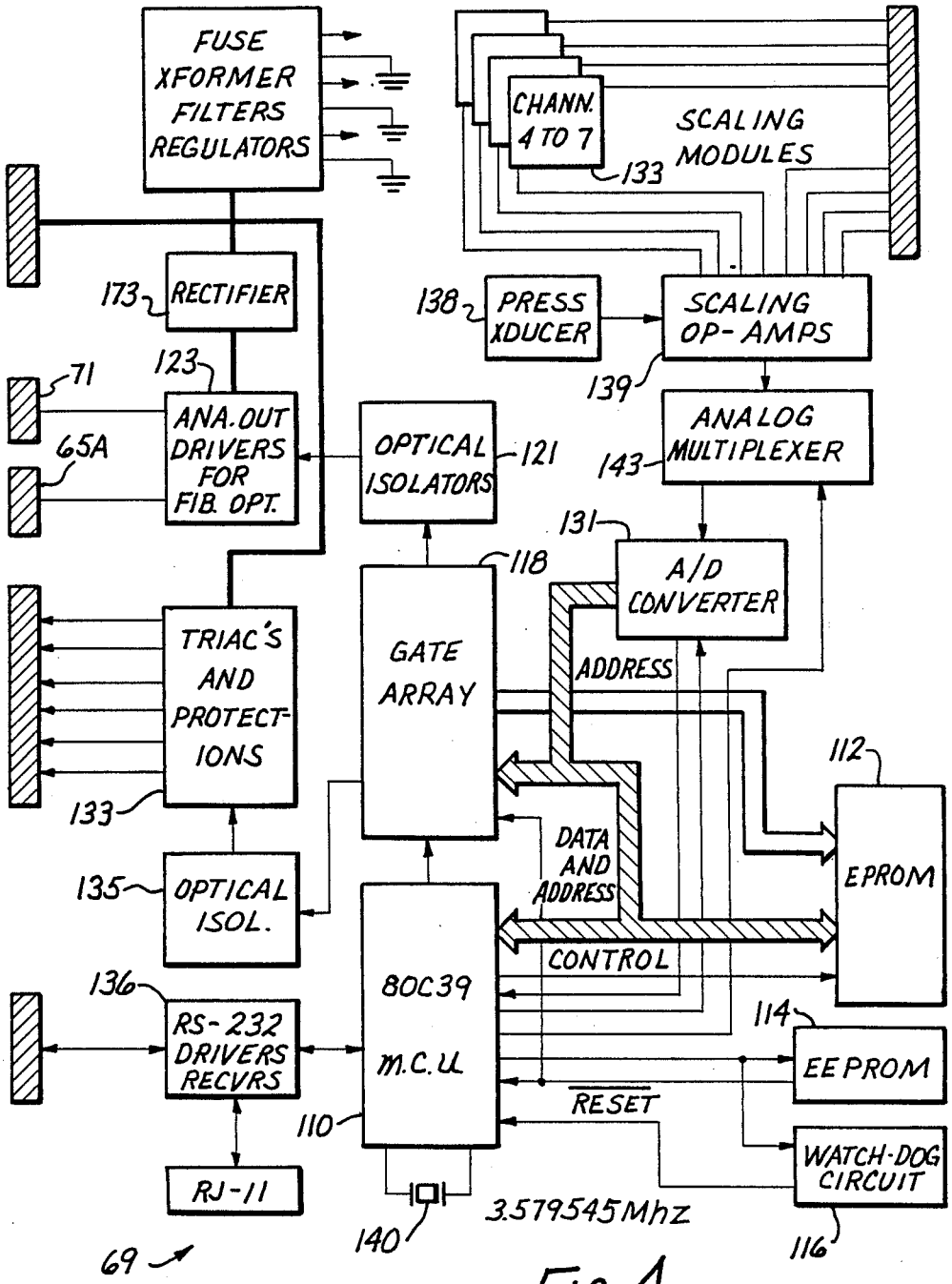
FIG. 4 is a symbolic block diagram of the controller of FIG. 1.

Referring now to FIG. 4, there is shown in greater detail, the controller 69. The controller 69 includes an eight bit microcomputer unit 110, which serves to control the functioning of the controller 69. An EPROM memory 112 stores the firmware program for controlling the operation of the controller 69 as executed by the unit 110. Also, for memory storage purposes, an EEPROM unit 114 is provided. Also, a watch-dog circuit 116 is utilized, as hereinafter described in greater detail.

Via a gate array 118, information is conveyed through an optical isolator 121 to an analog output driver arrangement 123, which in turn drives the terminators for the fiber optic connections 71 and 65A for the fan control and the heating element. The optical isolators 121 are used to further isolate electromagnetically the sensitive electronic circuits of the controller 69 from the modulating elements, to prevent, or at least greatly minimize, noise signals from interfering from the proper operation of the controller 69.

All the input and output connections for the controller 69 are terminated to 40 connector pins located on the controller. These connector pins make contact to the terminal blocks on the controller terminal base when the controller is plugged therein. All the external wires are terminated to this terminal blocks.

The one 28 pin memory socket accepts an 8 k×8 bytes CMOS EPROM memory 112. One serial electrically erasable read only memory (EEPROM) memory 114 replaces all the mechanical switches and potentiometers (not shown), used in prior known systems.

Eight analog input channels uses an analog to digital converter 131. Four channels are dedicated to specific applications and four channels are selectable for different base and span by use of plug-in scaling modules.

Six isolated digital output channels 133 are provided and is connected through optical isolators indicated at 135 to the gate array 135 for isolation purposes. These outputs are triac outputs, and each can drive a 24 v AC load of up to 10 VA. Additionally, there are two isolated phase chopped analog output parts. Each output is capable of driving a 13 VA device. A serial communication port interfaces a communication trunk. An RS-232 serial port 136 is used for service tool interface purposes. A PC mountable differential pressure transducer 138 is connected to operational amplifiers 139.

The 40 pin CMOS gate array 118 includes full or partial circuitry of different sections.

The watch dog circuit 116 monitors the proper operation of firmware. This circuit generates a reset when the firmware is not functioning properly.

The 80C39 CMOS micro-controller unit 110 provides three 8 bit bidirectional I/O ports, which are used for various functions.

The unit 110 is capable of addressing the external EPROM memory 112. A 28 pin memory socket is provided on the board which is used to accept an EPROM device.

The unit 110 uses 8 bits of the I/O port 0 for multiplexing data and address buses via a multiplexer (not shown). An 8 bit latch (not shown) is required to separate the address and data during an external memory operation. This 8 bit latch is incorporated in the gate array 118 in order to save cost and real estate.

The unit 110 has 128 bytes of internal RAM which can be used by firmware for various temporary storage purposes.

A serial EEPROM memory 114 is used on the controller 69 to allow storage of data which is needed to be preserved in case of power losses.

Figure 5:
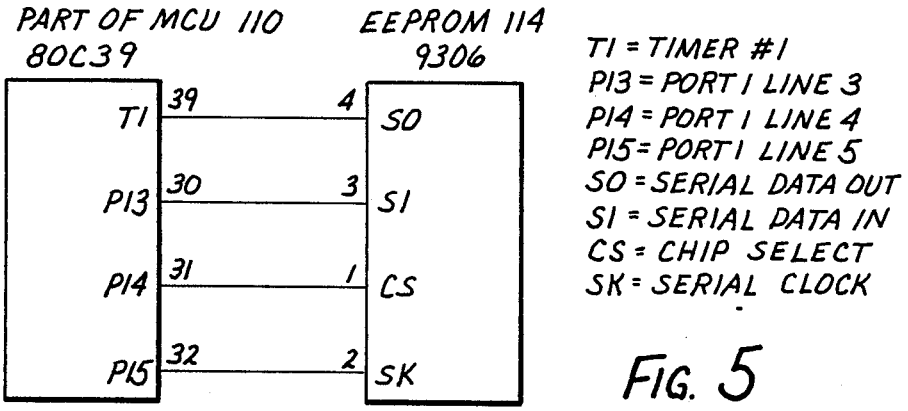

The diagram shown in FIG. 5 illustrates the interface between the MCU unit and the EEPROM memory.

The controller 69 provides 8 single ended analog input channels. Each channel has a pre-amplifier section which allows amplification of low level signals. The amplified signals from 8 channels are then fed to the analog multiplexer 143. The analog signal from the selected channel by the MCU unit is then converted to a digital value by the A/D converter 131. The MCU unit can read this digital value, and perform further processing on it.

Figure 6:
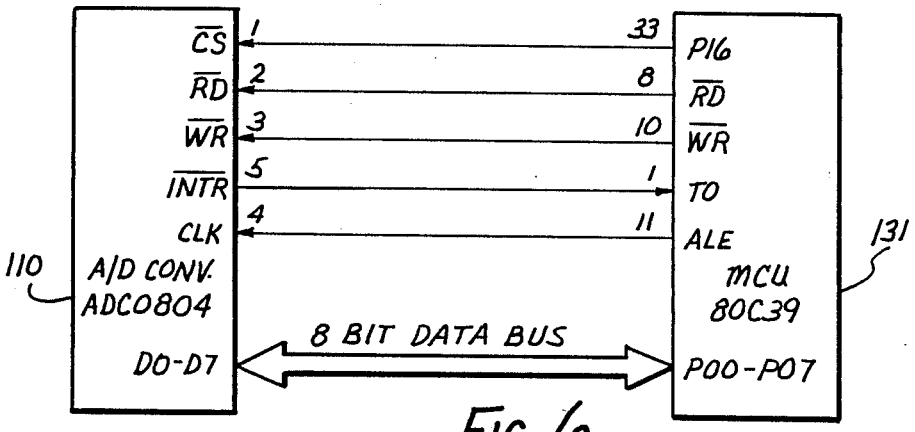

FIG. 6 shows the interface between the MCU unit and the A/D converter.

To increase the flexibility and capabilities of analog measurements, each channel is provided with an opamp of the amplifiers 139 which is used for pre-amplification of different analog signals.

The first four channels are set-up for specific applications. The gain and offset values of the last four channels can be changed by use of plug-in scaling modules.

The second set of four channels are designed to provide maximum flexibility for connection of different analog signals. Each channel has an 8 pin socket which is used to accept a scaling module. By using different scaling modules, the gain and offset of the amplifier can be changed for specific applications.

Figure 7:
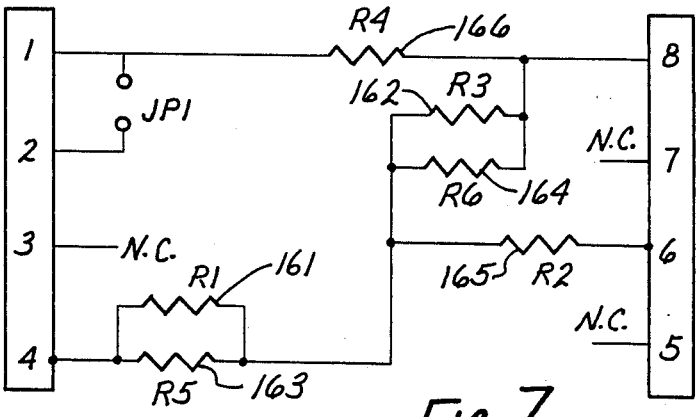

FIG. 7 shows the basic circuitry of the scaling module. The function of each component is as follows:

Resistors 161, 162, 163, and 164 are used for providing offset value;

Resistor 165 is used for determining the gain of the operational amplifier; and Resistor 166 is used to convert the channel to either temperature or binary input.

JP1 is installed if two adjacent channels are connected to an external pressure transducer.

Six digital output channels are provided on the board. These outputs are driven by triacs indicated at 133, and each triac is capable of switching a 24 volts AC to a maximum load of 10 VA, under the control of the MCU unit. These triac outputs are optically isolated from the logic circuitry of the controller 69 board. In addition to increase in the noise immunity of the controller, the isolation allows the main 24 V AC to be used as supply for devices driven by these outputs.

All of the digital output channels are shut off upon a board reset. This also means that all the channels are shut off initially when power to the board is turned on.

The controller provides two 20 V dc phase chopped outputs. These outputs are also optically isolated and can be used to drive two 13 VA magnetic valves or actuators or dc motors. The DC supply needed for operating the connected load is also provided on the controller by using a full wave rectifier 173.

The two analog output channels operate based on phase chop or pulse width modulation principles. The 24 V ac signal is rectified and converted to a dc voltage. This unfiltered 24 volt rectified voltage is supplied to load through a driver transistor.

The amount of power delivered to load is proportional to the time the driver transistor is turned on. The MCU unit can control the ON time of the transistor and consequently, the amount of power delivered to the load.

The MCU unit can control each analog output channel with a resolution of one part in 256. This corresponds to an 8 bit data written by the MCU unit to the modulating circuit.

To deliver any power to the load, firmware causes the calculation of an 8 bit binary data corresponding to that output value. This data is then written to the desired channel by activating the proper 10 lines. The circuitry on the controller and the gate array 118 perform the modulation based on that information.

Upon a hardware reset, both analog output channels are shut off.

The pulse width modulation signal, such as the one sent to the fan control, is generated by the gate array, which includes logic circuits (not shown). The gate array produces a signal with a frequency of 120 Hz. This frequency can be set to 100 Hz by removing jumper JP1. This signal is synchronized to the 24 V ac source supplying power to the board.

This signal is internally divided to 256 equal sections. The circuit recognizes the latched 8 bit binary data and based on that value, the signal is held high for that period of time. By writing data from 0 to 255 the ON time of this signal can be varied from 0% to 100%.

Figure 8:
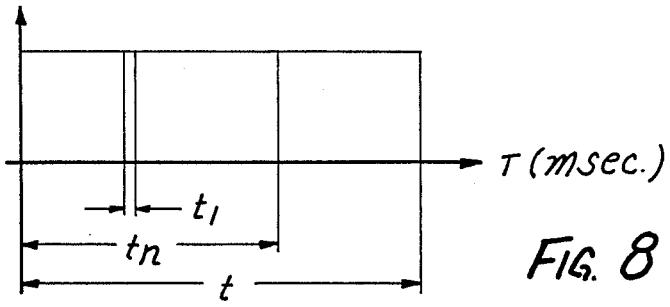
FIGS. 8, 9 and 10 are graphs, which are useful in understanding the operation of the controller of FIG. 4.
Figure 9:
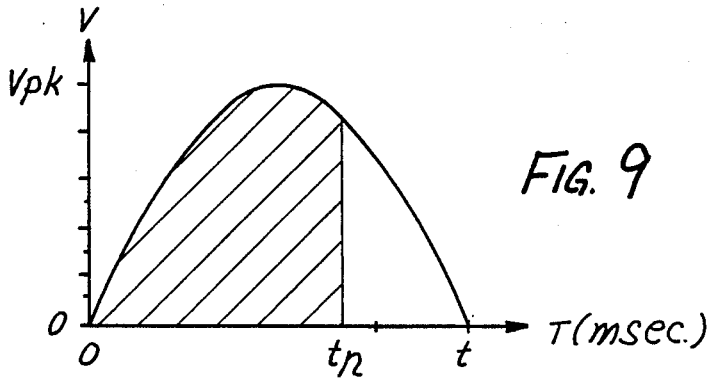

FIGS. 8 and 9 show the pulse width modulation performed on the controller 69.

For 60 cycle operation:

$$t = 8.333 \text{ msec.}$$

$$ti = \frac{8.333}{256} = 32.55\ \mu\text{sec.}$$

$n$ = decimal equivalent of 8 bit binary value of latched data $$t_n = n(32.55 \times 10^{-6})$$

For 50 cycle operation:

$$t = 10.000 \text{ msec.}$$

$$tl - \frac{10.000}{256} = 39.06\ \mu\text{sec.}$$

$$tn = n(39.06 \times 10^{-6})$$

As indicated in FIG. 1, the percentage of the power delivered to the load can therefore be varied by the 8 bit data latched by the MCU unit.

The fan output is set as follows:

$$\text{Fan Output \%} = 100 - \frac{(\text{Measured Duct Vel.} - \text{Min. Duct Vel.})}{\text{Fan Energize Vel.} - \text{Minimun Duct Vel.}}$$

(F) CONTROLLER FIRMWARE

Figure 11:
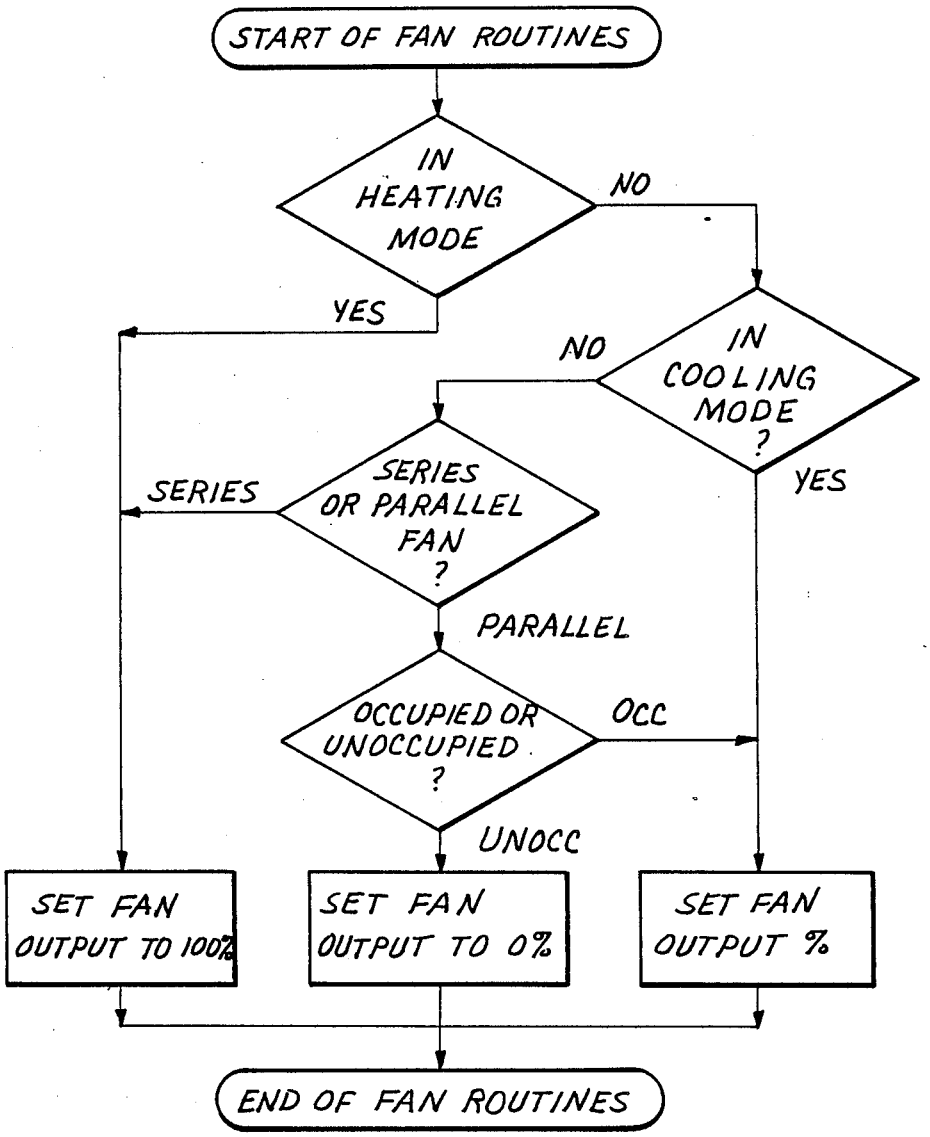
FIG. 11 is a flow chart diagram of the computer firmware stored in the controller for helping control the operation of the system of FIG. 1.
Figure 11A:
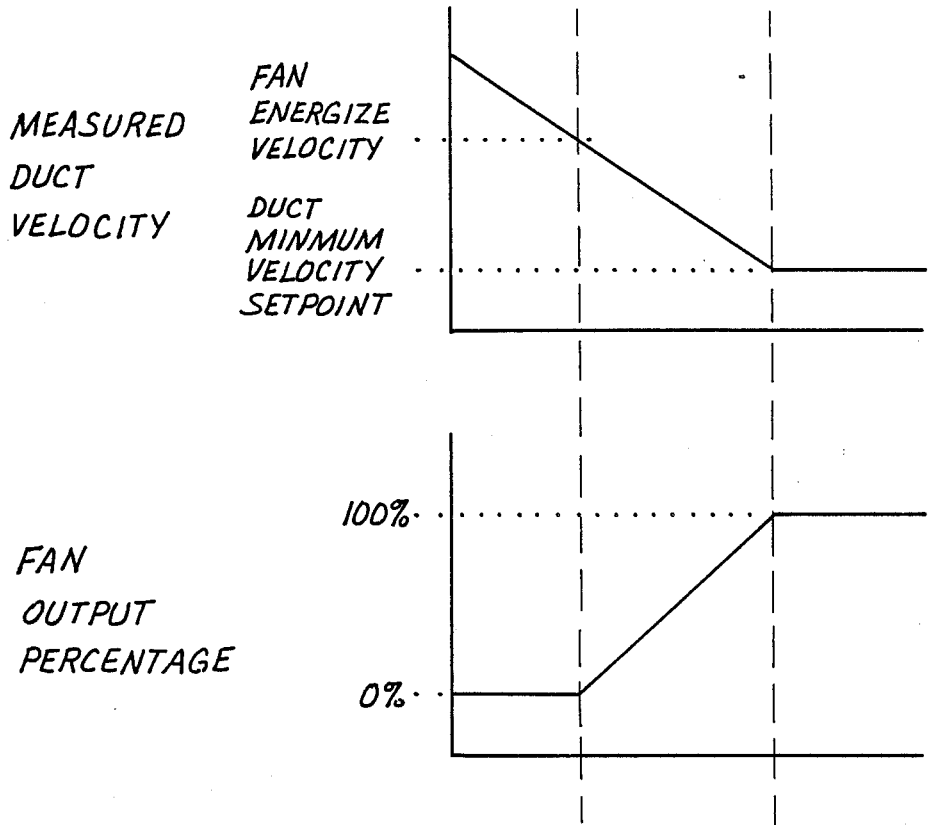

Referring now to FIGS. 11, and 11A, the controller firmware will now be described. As the controller firmware determines the amount of air to be supplied by the fan, it increases the ON time of the fiber optic control signal. As an example, the controller turns on the signal at 50% of its pulse width. In this condition, the SCR of the fan control is turned OFF for the first 50% of the cycle as described above.

When the signal turns ON at the middle of the cycle, the fiber optic receiver transistor senses the signal, and it turns ON. This provides a current path through transistor 90 and resistor R4 and causes the capacitor C1 to charge.

Capacitor C1 continues to charge until its voltage reaches the turn on voltage of transistor 103. At this time the transistor 103 turns ON which causes current flow through resistors R3 and R1 and raises the voltage of resistor R1 above the SCR turn ON limit. This causes the SCR to turn ON and supply power to the load.

At the end of each cycle when the AC source current goes to zero, the SCR automatically turns off. In the following cycle and every cycle after that this process continues and therefore the average power supplied to motor equals 50% of the maximum power.

The amount of power supplied to the fan can be varied from 0% to 100% in the same manner.

The output voltage of each channel is proportional to the value of the 8 bit data written to that channel. It is also related to the power supply and the voltage drops cross the rectifier and the driver transistors.

To establish the input/output relation it will be assumed that the supply is at 24 V ac and a total voltage drops is 1.8 Volts. The following formula characterizes the output voltage vs. the input data N. This is the average value of the output voltage which can be measured by a voltmeter.

$$Vsup = 24 - 1.8 = 22.2 \text{ V}$$
$$Vpk = 22.2 \times 1.414 = 31.4 \text{ V}$$

$$Vout = \frac{Vpk}{\pi}\left[1 - \cos\left(\frac{N \times \pi}{255}\right)\right]$$

Figure 10:
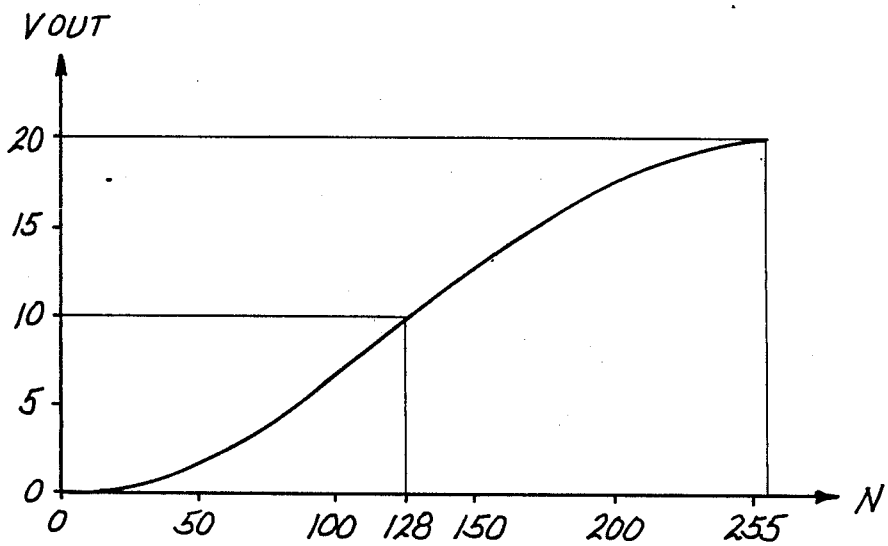

The diagram of FIG. 10 is a graphical representation of the above formula.

The controller 69 provides a serial communication port and the required circuitry to interface to other trunk equipment (not shown).

The driver and receiver circuitry of this communication trunk equipment is optically isolated from the logic circuit of the board. A fuse, a transorb and a diode are also used on the board to increase the protection of the board from miss-wiring of the trunk.

Up to 64 controller units can be multi-dropped on the trunk equipment. The trunk uses a two wire configuration and therefore is a half duplex trunk. The transmit and receive data appear on the same two wires and software protocols must avoid data collision between them.

The receiver thresholds has been set up to allow connection of up to 64 units per trunk. The trunk is connected to pins 22 and 21 (not shown) of the terminal block. Pin 22 (not shown) is TR+ signal and pin 21 is TR− signal. Pin 22 of all the smart devices must be connected together and pin 21 of all the devices must be connected for proper trunk operation.

An RS-232 serial communication port is provided on the controller to communicate to the service tool. The service tool interfaces to the controller by connecting to the RJ-11 connector which is mounted on the controller board. Transmit data, receive data and signal common are available on this connector on pins 1, 2 and 4 respectively (not shown). In addition to these signals an input is provided on connector RJ-11 which allows the service tool to select two different modes of communication.

This input signal (TR/ST−) is connected to pin 3 (not shown) of the connector RJ-11. When this input is low, the service tool mode is selected and when the signal is high the trunk mode is selected.

In the service tool mode, the controller is isolated from the main communication trunk and all the communication activities occurs only between the controller and the service tool. This will allow the service tool to define all the parameters in that particular controller without effecting the other controllers on the trunk.

In trunk mode the service tool is capable of monitoring the communication trunk and all the communication activities occurring on the trunk. In this mode the service tool transmit signals are ignored by the controller, and the service tool becomes effectively a listening device.

The controller 69 allows mounting and interfacing a differential pressure transducer on board. The output of the transducer is connected to the analog input channels three and four of the operational amplifier 139. The gain and offset values of the pre-amplifiers of these channels are pre-determined and if any changes are made to the range of signals produced by the transducer the resulting values will be incorrect.

The controller 69 provides capabilities for substituting if desired two fiber optic drivers (not shown) in place of the optical isolators 121 used in the analog output circuitry.

The fiber optic ports are addressed by the same MCU I/O ports as the analog output channels. The operation of these ports are identical to the analog outputs. By writing a digital value between 0 and 255, the MCU unit is capable of modulating the pulse width of fiber optic link.

When the fiber optic option is employed, the frequency of the pulse being modulated by the MCU unit is selectable by jumper JP1 (FIG. 7). When JP1 is not installed the frequency is 120 Hz. Installing the JP1 jumper changes the operation to 100 Hz which is suitable for operation in countries with 50 cycle power line frequency.

In order to minimize the cost of the controller and at the same time make it compact in size, a 40 pin CMOS gate array is used to integrate as many discrete logic components as possible.

A watch dog circuit is provided on the controller to monitor the proper operation of the firmware. The watch dog circuit is basically an analog integrator which its input is an I/O port from the MCU unit and its output is connected to the RESET input of the MCU unit.

As long as the input toggled by software 10 times per second, the output remains high. If the input does not toggle fast enough or does not change at all, the circuit threshold is exceeded and the output is switched low. This causes a reset to the MCU unit and will start the firmware operation.

While particular embodiments of the present invention have been disclosed, it is to be understood that various different modifications are possible and are contemplated within the true spirit and scope of the appended claims. For example, while the novel system of the present invention has been shown and described to be a parallel fan system, it will become apparent to those skilled in the art that the inventive system may also be a series fan arrangement as well. There is no intention, therefore, of limitations to the exact abstract o disclosure herein presented.

What is claimed is:

1. A ventilation system for supplying conditioned low temperature primary air under pressure to a space, comprising:

sensing means for measuring continuously the quantity of primary air currently available for entering the space, the temperature of the air in the space, and the volume of air entering the space;

damper means for supplying a desired quantity of the currently available primary air under pressure to the space;

motive means for supplying a desired quantity of return air under pressure substantially continuously and uninterruptably to the space to condition the air therein;

signal means responsive to said sensing means for generating a pair of signals indicative of a desired quantity of return air conveyed from the space and a desired quantity of the currently available primary air under pressure needed to control the condition of the air in the space;

means for conveying return air from the space to said motive means;

primary air control means responsive to one of said signals for causing said damper means to vary continuously the quantity of currently available primary air under pressure for entering the space relative to the temperature in the space;

return air control means responsive to the other one of said signals for causing said motive means to vary continuously the flow rate of said return air under pressure in a functionally related manner relative to the quantity of available primary air currently needed to condition the air in the space; and means responsive to said sensing means for causing said signal means to vary said signals substantially continuously and in a functionally related manner relative to the temperature in the space and the flow rate of the currently available primary air under pressure.

2. A system according to claim 1, wherein said functionally related manner is an inversely proportional manner.

3. A system according to claim 1, wherein said return air control means includes means responsive to the other one of said signals for generating a pulse width modulating signal.

4. A system according to claim 3, wherein said means responsive to the other one of said signals includes a high voltage switching circuit for controlling said motive means.

5. A system according to claim 1, further including a light conduit interconnecting said return air control means and said signal means for supplying said inversely proportional signal from said signal means to said return air control means.

6. A system according to claim 1, further including heating means for increasing the temperature of the air entering the space, and a light conduit interconnecting said signal means and said heating means, and wherein said signal means including means for generating a heating control signal and of supplying it via said light conduit to said heating means to adjust continuously the amount of heat being generated therefrom.

7. A system according to claim 1, wherein said damper means includes a mixing chamber for receiving the desired quantity of said primary air under pressure and the desired quantity of said return air under pressure; and a damper unit responsive to one of said signals for continuously controlling the quantity of currently available primary air that will be received in said mixing chamber.

8. A method for supplying conditioned air to a space as recited in claim 7, further including the steps of:

using a mixing chamber;

receiving the desired quantity of said primary air under pressure and the desired quantity of return air under pressure in said mixing chamber; and controlling the quantity of currently available primary air that will be received in said mixing chamber relative to the flow rate of said primary air and the temperature of the air in the space.

9. A method for supplying conditioned air to a space as recited in claim 8, further including the step of heating the air entering the space to control the temperature of the air in the space.

10. In a ventilation system for supplying conditioned low temperature air under pressure to a space, a terminal unit comprising:

a housing mounted in close proximity to the space;

damper means for supplying a desired quantity of currently available primary air under pressure to the space for conditioning purposes;

motive means for supplying a desired quantity of return air under pressure substantially continuously and uninterruptably to the space to condition the air therein;

controller means mounted to the housing for monitoring continuously the flow rate of the primary air, the temperature of the air in the space, and of the volume air entering the space; and said controller means including air control means for generating signals to cause said motive means to vary the flow rate of the quantity of the return air under pressure and to cause said damper means to vary the quantity of available primary air for entering the space, in a functionally related manner relative to the quantity of primary air available for cooling purposes and the temperature in the space.

11. A ventilation system according to claim 10, further including fan control means responsive to said controller means for varying the driving speed of said motive means; and said fan control means being disposed remotely of said controller means and being interconnected thereto by light conduct means.

12. A ventilation system according to claim 10, wherein said air control means includes heating means for increasing the temperature of the air entering the space.

13. A method for supplying conditioned low temperature primary air under pressure to a space, comprising:

measuring continuously the quantity of primary air currently available for entering the space, the temperature of the air in the space, and the volume of air entering the space;

supplying a desired quantity of the currently available primary air under pressure to the space;

using motive means for supplying a desired quantity of return air under pressure substantially continuously and uninterruptably to the space to condition the air therein;

generating a pair of signals indicative of a desired quantity of return air conveyed from the space and a desired quantity of the currently available primary air under pressure needed to control the condition of the air in the space;

conveying return air from the space to said motive means;

causing said damper means in response to one of said signals, to vary continuously the quantity of currently available primary air under pressure for entering the space relative to the temperature in the space;

causing said motive means, in response to the other one of said signals, to vary the flow rate of said return air under pressure in a functionally related manner relative to the quantity of primary air currently available to condition the air in the space; and causing said signal means to vary said signals substantially continuously an in a functionally related manner relative to the temperature in the space and the flow rate of the currently available primary under pressure.

14. A system according to claim 1, further including inhibit means responsive to said sensing means for temporarily preventing said motive means from supplying air under pressure at said higher temperature when the air flow of said primary air is less than a certain pre-established rate.

15. A method for supplying conditioned low temperature primary air under pressure to a space according to claim 13 wherein said functionally related manner is an inversely proportional manner.

16. A system according to claim 14, wherein said mixing chamber is in atmospheric communication with heat producing means to permit the air flowing from said chamber to be heated to a predetermined desired temperature to control the temperature of the air in the space.

17. A system according to claim 14, further including a terminal housing, and wherein said motive means, said primary air control means, and said return air control means are all mounted to said housing.

18. A system according to claim 17, wherein said signal means includes a microprocessor control unit and a memory storing a control program.

19. A system according to claim 18, wherein said motive means includes a fan.

* * * * *

UNITED STATES PATENT AND TRADEMARK OFFICE

CERTIFICATE OF CORRECTION

PATENT NO. : 4,942,921

DATED : July 24, 1990

INVENTOR(S) : David L. Haessig

It is certified that error appears in the above-identified patent and that said Letters Patent is hereby corrected as shown below:

Column 7, line 4 & 5, after "If", delete "additional", and substitute therefor --addition--.

Column 16, line 47, after "abstract", delete "o", and substitute therefor --or disclosure herein presented--.

Signed and Sealed this

Twenty-ninth Day of September, 1992

*Attest:*

DOUGLAS B. COMER

*Attesting Officer*

*Acting Commissioner of Patents and Trademarks*